US012571063B2

(12) United States Patent
Liu et al.

(10) Patent No.: US 12,571,063 B2
(45) Date of Patent: Mar. 10, 2026

(54) 9Ni STEEL PLATE FOR SHIP LNG STORAGE TANK WITH HIGH STRENGTH AND LOW YIELD RATIO AND ITS PRODUCTION METHOD

(71) Applicant: JIANGYIN XINGCHENG SPECIAL STEEL WORKS CO., LTD, Jiangyin (CN)

(72) Inventors: Zhaoxia Liu, Jiangyin (CN); Guozhong Li, Jiangyin (CN); Xiaohong Xu, Jiangyin (CN); Yun Bai, Jiangyin (CN); Pifeng Miao, Jiangyin (CN); Jun Liu, Jiangyin (CN); Yonghao Zhou, Jiangyin (CN); Buqiang Han, Jiangyin (CN); Jinming Wu, Jiangyin (CN)

(73) Assignee: JIANGYIN XINGCHENG SPECIAL STEEL WORKS CO., LTD, Jiangyin (CN)

( * ) Notice: Subject to any disclaimer, the term of this patent is extended or adjusted under 35 U.S.C. 154(b) by 662 days.

(21) Appl. No.: 17/927,881

(22) PCT Filed: Apr. 9, 2020

(86) PCT No.: PCT/CN2020/084014
§ 371 (c)(1),
(2) Date: Nov. 26, 2022

(87) PCT Pub. No.: WO2021/036272
PCT Pub. Date: Mar. 4, 2021

(65) Prior Publication Data

US 2023/0323494 A1 Oct. 12, 2023

(30) Foreign Application Priority Data

Aug. 24, 2019 (CN) ..... 201910786113.1

(51) Int. Cl.
*C21D 8/02* (2006.01)
*C21D 8/0221* (2026.01)
(Continued)

(52) U.S. Cl.
CPC ..... *C21D 8/0226* (2013.01); *C21D 8/0205* (2013.01); *C21D 8/0273* (2013.01);
(Continued)

(58) Field of Classification Search
CPC .. C21D 8/0226; C21D 8/0205; C21D 8/0273; C21D 8/0278; C21D 9/46;
(Continued)

(56) References Cited

U.S. PATENT DOCUMENTS

2021/0108298 A1* 4/2021 Kagaya ..... C22C 38/02

FOREIGN PATENT DOCUMENTS

CN 107604255 A 1/2018
CN 110129676 A 8/2019
(Continued)

OTHER PUBLICATIONS

International Search Report of PCT/CN2020/084014 mailed on Jun. 29, 2020, ISA/CN.

*Primary Examiner* — Ricardo D Morales
(74) *Attorney, Agent, or Firm* — JEEN IP LAW, LLC

(57) ABSTRACT

The invention relates to a 9Ni steel plate for ship LNG storage tank with high strength and low yield ratio. According to the mass percentage, the chemical constituents are C: 0.02-0.05%, Si: 0.10-0.30%, Mn: 0.50-0.80%, Ni: 8.90-9.50%, P: ≤0.0070%, s: ≤0.0020%, Cr: 0.10-0.25%, Alt: 0.010-0.035%, Nb: 0.010-0.020%, Ca: 0.0005-0.0030%, O: ≤0.0012%, N: ≤0.004%, H: ≤0.00015%, and the balance is Fe and unavoidable impurity elements. The production process flow is: smelting in a converter or electric furnace→RH vacuum degassing→LF refining→RH high vacuum
(Continued)

degassing→Ca Treatment→continuous casting→slab slow cooling treatment→slab surface cleaning→heating→rolling→quenching→tempering. For the 9Ni steel, especially the 9Ni thin steel plate, the invention adopts the constituents design of low C, 9% Ni, addition of Nb and Cr. The steel plate is subject to high-temperature hot rolling, and then QLT heat treatment process to obtain 9Ni steel with good strength, toughness and low yield ratio.

4 Claims, 1 Drawing Sheet

(51) Int. Cl.

| | |
|---|---|
| ***C21D 8/0247*** | (2026.01) |
| ***C21D 8/0278*** | (2026.01) |
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/48*** | (2006.01) |

(52) U.S. Cl.
CPC ..... *C21D 8/0278* (2013.01); *C21D 9/46* (2013.01); *C22C 38/002* (2013.01); *C22C 38/02* (2013.01); *C22C 38/04* (2013.01); *C22C 38/06* (2013.01); *C22C 38/48* (2013.01); *C21D 2211/005* (2013.01)

(58) Field of Classification Search
CPC ..... C21D 2211/005; C21D 2211/009; C21D 1/19; C21D 1/25; C21D 1/60; C21D 6/001; C21D 8/021; C21D 8/0263; C21D 1/18; C22C 38/002; C22C 38/02; C22C 38/04; C22C 38/06; C22C 38/48; C22C 38/12; C22C 33/04; C22C 38/001; C22C 38/34
See application file for complete search history.

(56) References Cited

FOREIGN PATENT DOCUMENTS

| | | | |
|---|---|---|---|
| CN | 110541110 | A | 12/2019 |
| WO | 2007080646 | | 6/2009 |
| WO | 2019087318 | A1 | 5/2019 |
| WO | 2019124671 | A1 | 6/2019 |

* cited by examiner

9Ni STEEL PLATE FOR SHIP LNG STORAGE TANK WITH HIGH STRENGTH AND LOW YIELD RATIO AND ITS PRODUCTION METHOD

The present application is a U.S. National Phase application based upon PCT Application Serial No. PCT/CN2020/084014 filed Apr. 9, 2020, which claims the benefit of priority to Chinese patent applications No. 201910786113.1, titled "HIGH-STRENGTH AND LOW-YIELD-RATIO 9NI STEEL PLATE FOR SHIP LNG STORAGE TANKS AND MANUFACTURING METHOD THEREFOR", the entire disclosures of which are incorporated herein by reference.

TECHNICAL FIELD

The invention belongs to the field of iron and steel (iron-based alloy) metallurgy, in particular to a 9Ni steel plate for LNG ship with high strength and low yield ratio and a production method thereof.

BACKGROUND ART

LNG is the abbreviation of liquid natural gas. It is a clean and efficient energy. It can be liquefied at −162° C. and the liquefied volume is reduced to 1/600 of the original volume, greatly saving storage and transportation space. LNG also has the characteristics of high calorific value and high performance. In many countries, LNG is listed as the preferred fuel. China uses LNG to optimize the domestic energy allocation structure, ensure the security of energy supply, protect the ecological environment and realize the sustainable development of economy and society. LNG transportation mainly depends on large ships. Tanks are built on ships. The materials of tanks must have sufficient strength, toughness and low yield ratio.

Compared with stainless steel, 9Ni steel has the advantages of relatively low alloy content and low price, and has the advantages of large allowable stress and low thermal expansion rate compared with aluminum alloy for low temperature. Therefore, 9Ni steel is selected as the main material of LNG tank. Due to the high Ni content, high surface quality requirements and strict requirements for impurity elements of 9Ni steel, a series of problems have been brought to smelting, rolling and heat treatment. At present, there are few enterprises that can successfully realize mass production. Besides it is not accepted by users on the domestic market, there are only a few domestic manufacturers that can actually supply goods to the market.

In addition, high strength, used in −196° C. cryogenic environment and high yield ratio are also important factors restricting the production of 9Ni steel. In particular, the yield ratio has great restrictions on the project. For example, in the application of pipeline steel, considering Bauschinger effect, the important clause for the use of pipeline steel in the project is that the yield ratio shall not be higher than 0.92, and for steel for high-rise building, the yield ratio shall not be higher than 0.85. LR classification society rules also require that the yield ratio of all ship steel, including 9Ni steel, shall not be higher than 0.94.

For the sake of safety, shipowners usually require that 9Ni steel for LNG ships also meet the requirements of X7Ni9 corresponding to European standard En10028-4 or SA553 type-I corresponding to American Standard on the basis of meeting the specifications of classification society. In European standards and American standards, the yield strength of 9Ni steel is 680 MPa and 690 MPa respectively. According to the actual supply of 9Ni steel, the higher the yield strength of 9Ni Steel under the same constitution system, the more difficult it is to control the yield ratio, and the thinner the steel plate, the higher the yield ratio. This is because the as delivered microstructure of 9Ni steel is fine tempered sorbite. The finer the grain, the higher the yield strength and the higher the yield ratio.

In the prior art, Chinese patent CN103602888 discloses a hot-rolled 9Ni thick steel plate with low compression ratio and a production method thereof. The method obtains 9Ni steel without heat treatment in the hot-rolled state. The structure is tempered martensite as base+4-15% reverse tempered austenite. Although, only embodiment 1 reaches the lower limit of yield strength in the European standard, and the yield ratio is greater than 0.93. Chinese patent CN10125668 discloses a production method of 9Ni steel. Its production process is mainly to simulate continuous casting and rolling process, so as to shorten the production process, which is difficult to achieve in industrial production, and the product strength is low, which cannot meet the actual supply requirements. Chinese patent CN101864537 discloses a production method of 9Ni steel containing Cu, with a production thickness of 20 mm. After hot rolling, conduct laminar cooling to below 200° C., there will be large balance stress in this process, which is not suitable for shape control of thin and wide steel plate. In addition, although the yield strength of the steel plate is as high as 710 MPa, the high toughness of 9Ni steel is sacrificed. The impact value of the actual steel plate at −196° C. is only 120 J, and there is little surplus for batch supply.

In order to solve the shortcomings of the current art, 9Ni steel, especially 9Ni steel plate with thin specification, is designed with low C, 9% Ni, Nb and Cr added, hot rolled at high temperature. Special QLT heat treatment process is carried out to obtain 9Ni steel with good strength and toughness (strength and toughness) and low yield strength ratio, which is easy to control the surface quality and shape of 9Ni steel plate with wide and thin specification.

DETAILED DESCRIPTION OF THE INVENTION

In view of the defects of high yield ratio or insufficient low-temperature toughness of thin 9Ni steel plate in the prior art, the invention carries out low C, 9% Ni, increases Nb and Cr constituents design for 9Ni steel, especially thin 9Ni steel plate, carries out high-temperature hot rolling, and then carries out special QLT heat treatment process,9Ni steel with good strength and toughness (strength and toughness) and low yield ratio is obtained, and it is easy to control the surface quality and shape of wide and thin 9Ni steel plate.

In order to achieve the above purpose, the design of the chemical constituents of the steel plate are as follows: C: 0.02-0.05%, Si: 0.10-0.30%, Mn: 0.50-0.80%, Ni: 8.90-9.50%, P: ≤0.0070%, s: ≤0.0020%, Cr: 0.10-0.25%, Alt: 0.010-0.035%, Nb: 0.010-0.020%, CA: 0.0005-0.0030%, O: ≤0.0012%, N: ≤0.004%, H: ≤0.00015%, and the balance is Fe and unavoidable impurity elements.

The reasons for defining the steel constituents in the invention are described as follows:

The addition of C can increase the hardenability of the steel, especially in the production of medium and heavy plates, and can significantly improve the strength. However, too much C content is not conducive to the −196° C. ultra-low temperature impact performance, ultra-low temperature strain aging performance, welding performance and corrosion resistance of the steel. Therefore, the carbon content in the invention is controlled between 0.02-0.05%.

Si is mainly used for deoxidation. Although the addition amount must be determined according to different smelting methods, in order to obtain good steel plate performance, it must be more than 0.10% in the iron oxide scale. However, if it exceeds 0.30%, it is easy to form silicon aluminum spinel and is not easy to remove. Considering that the surface quality of 9Ni steel is particularly important, the invention controls the low Si content and stipulates that the upper limit is 0.30%.

Mn is an element to improve the hardenability of steel and plays the role of solid solution strengthening to make up for the strength loss caused by the decrease of C content in steel. When the content of Mn in steel is too low, it cannot give full play to the role of strength assurance, but when the content of Mn is too high, it will increase its carbon equivalent and damage the welding performance. In addition, Mn is easy to produce segregation in the center of the steel plate and reduce the impact toughness in the center of the steel plate. Therefore, the Mn content of the invention is controlled to be 0.50-0.80%.

Ni is an element that can improve the hardenability of steel plate and significantly improve its low-temperature toughness. It has a good effect on impact toughness and ductile brittle transition temperature. However, when the Ni content is too high, iron oxide scale with high viscosity is easy to form on the surface of slab, which is difficult to remove, affecting the surface quality of steel plate. In addition, Ni is also a precious metal, and too high content will increase the cost. Therefore, on the premise of meeting the requirements of classification society specifications, European standards and American standards, the content of the invention is controlled at 8.90-9.50%, which is conducive to achieving the optimal cost performance.

Cr is an element to improve the hardenability of steel, which can inhibit the formation of polygonal ferrite and pearlite, promote the transformation of low-temperature martensite, and improve the tensile strength of steel during quenching. However, too high Cr content will affect the toughness of steel and cause tempering brittleness. The chromium content in the invention is controlled at 0.10-0.25%.

The solute drag effect of Nb and the pinning effect of Nb (C, N) on austenite grain boundary inhibit the recrystallization of deformed austenite and expand the non-recrystallization range of austenite, which can improve the start temperature of finish rolling, ensure the plate shape, easy to realize high-temperature rolling, reduce the yield ratio of steel plate and avoid the temperature range of secondary iron oxide scale formation. However, too much NB will also lead to the formation of fine grains of the steel plate and improve the yield ratio. Therefore, the invention controls its content in a narrow range of 0.010-0.020%.

Ca treatment is a necessary treatment link of the steel grade of the invention. 0.0005-0.0030% CA can not only reduce the performance harm caused by sulfide, but also change the sharp $Al_2O_3$ inclusion into a spherical low melting point inclusion, so as to reduce the generation of microcracks at the sharp edges of hard inclusions during steel plate rolling and improve the impact toughness of steel plate.

Although P can improve corrosion resistance, it will reduce low-temperature toughness and affect the weldability of steel plate, which is inappropriate for structural steel. The invention stipulates that it shall be controlled below 0.0070%.

S forms MnS inclusions, which will also lead to center segregation and have adverse effects on corrosion resistance. The invention stipulates that it shall be controlled below 0.0020%.

Al mainly plays the role of nitrogen fixation and deoxidation. AlN formed by the bonding of Al and N can effectively refine the grain, but too high content will damage the toughness of the steel. Therefore, the content (Alt) of the invention is controlled at 0.010-0.035%.

O, N: harmful gas elements. They are of high content and in large amount of inclusions, which reduce the plasticity, toughness and welding bending properties of steel plate. The invention strictly controls the O content not higher than 0.0012%; N content is not higher than 0.004%.

H: Harmful gas elements. High H content is easy to produce white spots, reduce the plastic toughness of the steel plate, and seriously endanger the service performance of the steel plate. H-INDUCED delayed crack is one of the main causes of failure in the application process of cutting and cold bending of high strength steel. In order to improve the comprehensive performance of the steel plate, the H content is strictly controlled within 0.00015%.

The invention also provides a production method of the above 9Ni steel plate for LNG ship with high strength, low yield ratio and good low-temperature toughness. The specific process is as follows.

Smelting and continuous casting process: The smelting raw materials are successively processed by converter smelting, RH refining, LF refining and RH refining. In order to control the internal porosity and segregation of steel plate, low overheat pouring, whole process argon protection pouring and dynamic soft reduction control are carried out. The casting overheat shall be controlled at 5-25° C.; The soft reduction is controlled at $0.40 \leq fs \leq 0.90$, where fs is the number of solid phases in the slab to ensure that the center segregation of the slab is not higher than grade C1.0.

Slow cooling, cleaning and grinding process of slab: after the slab is offline, slow cooling treatment must be carried out. slabs are required to be stacked into pits or covered. The start temperature of slow cooling shall not be lower than 600° C., and the time shall not be lower than 48 hours. The surface of the slab shall be polished and cleaned by machine, so that the upper and lower surface of the slab shall be cleaned up by removing 1.5 mm thick.

Heating process: The slab is sent to the stepping type furnace with an average heating rate of 10-14 cm/min. In order to ensure high-temperature rolling, it is heated to 1180-1250° C., and the heat holding starts when the core temperature reaches the surface temperature, and the heat holding time is not less than 1 hour. The alloy elements in the steel are fully dissolved to ensure the uniformity of constituents and properties of the final product. The heating time in the temperature range of 600-900° C. shall be controlled to be ≥0.32 min/mm.

Rolling process: after the slab is removed out of the furnace and descaled by high-pressure water, the two-stage control rolling of rough rolling and finish rolling is carried out, in which the start rolling temperature of rough rolling is 1080-1150° C., and the reduction rate of the last three single passes of rough rolling is ≥15%. The thickness of an intermediate slab≥1.8 h, where h is the thickness of finished product. High temperature rolling is adopted for finish rolling, and the start rolling temperature is between 900-980° C. After rolling, the steel plate is cooled by air without accelerated cooling by ACC unit.

Quenching heat treatment process: after rolling, the steel plate shall be subject to off-line quenching treatment.

According to the measurement of the steel of the invention, the start temperature of ferrite austenite equilibrium transformation $AC_1$ is 608° C., and the ending temperature of ferrite austenite equilibrium transformation $AC_3$ is 725° C. The first quenching (primary quenching) temperature is 840±10° C., and the holding time after the furnace temperature reaches the temperature is 30-60 min. The secondary quenching (secondary quenching) temperature is 625±10° C., and the holding time after the furnace temperature reaches the temperature is 30-60 min. In order to ensure the uniformity of the steel plate, the temperature control accuracy is ±10° C.

Tempering heat treatment process: after quenching, the steel plate shall be tempered at 560±10° C. After ½ of the thickness of the steel plate reaches the temperature, the tempering holding time is 120-180 min, and sufficient time is given to fully diffuse the carbon in the quenched martensite to obtain ferrite. In the subsequent long-term holding process, the ferrite sheet grows to ensure the best matching of strength and toughness of the steel plate, reduce the yield ratio of the steel plate and improve the engineering application of the steel plate.

Compared with the prior art, the invention is characterized by:

The invention adopts low C, high Ni and addition of Cr to ensure the hardenability of the steel plate, improve the tensile strength of the steel plate, reduce the yield ratio, increase the Nb content, ensure the high-temperature rolling of the steel plate, and obtain the initial deformed austenite grains with relatively uniform and large grains. Using the heredity of steel plate structure, larger parent austenite is obtained in the process of quenching and heat preservation.

The invention adopts a series of means such as cleaning the upper and lower surfaces of the slab by removing a thickness of 1.5 mm, controlling heating in the heating process, high-pressure water descaling, high-temperature rolling, etc. to ensure that the steel plate has good surface quality.

By adding Nb, segmented heating control, high-temperature rolling and no watering after rolling, the invention not only ensures the good shape of 9Ni steel plate, but also prevents the scratch of steel plate caused by straightening, which affects the surface quality of steel plate.

The invention ensures the low C content control stability of the steel plate through double RH treatment.

Through heat treatment, the invention increases the primary quenching temperature to ensure the large size of the initial austenite grain, and the secondary quenching forms a structure with the coexistence of large and small austenite grains to ensure the low yield ratio of the final steel plate.

The invention carries out tempering treatment at a temperature higher than and close to $AC_1$ and maintains heat for a long time to ensure the ferrite content in the tempered sorbite structure of the steel plate and coarsen the ferrite, so that the maximum ferrite layer can reach 2 um. Improve the toughness of the steel plate and reduce the yield ratio. For 12-50 mm thick steel plate, the yield strength is ≥590 MPa, the tensile strength is 680-820 Mpa, the yield ratio is ≤0.90, the elongation is ≥20%, and the impact toughness at −196° C. is ≥200 J.

DESCRIPTION OF THE ATTACHED DRAWINGS

DETAILED DESCRIPTION OF EMBODIMENTS

Figure 1:
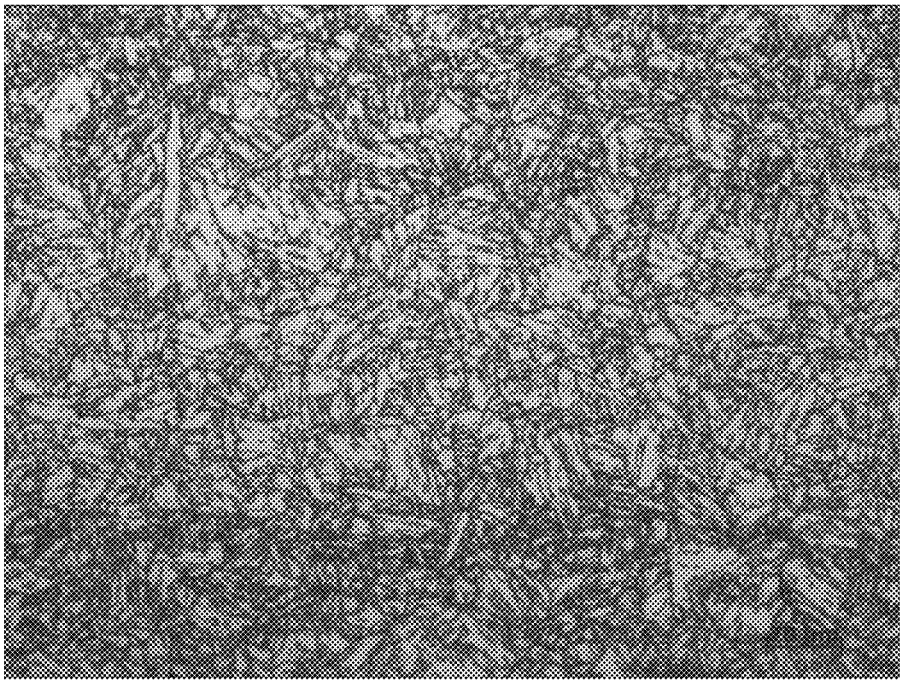
FIG. 1 is a typical microstructure metallographic diagram of the test steel in embodiment 2 of the present invention.

The invention is described in further detail below in combination with the embodiments with the attached drawings.

The production process of 9Ni steel plate for LNG ship with high strength and low yield ratio is as follows: smelting in a converter or electric furnace->RH vacuum degassing->LF refining->RH high vacuum degassing->Ca Treatment->continuous casting->slab slow cooling treatment->slab surface cleaning->heating->rolling->quenching->tempering.

The production method of 9Ni steel plate for LNG ship with high strength and low yield ratio in embodiments 1-4 of the invention comprises the following steps:

(1) Smelting: Select high-quality raw materials, use 150 t converter for smelting, send them to LF furnace for refining after RH high vacuum degassing treatment, break the air for Ca treatment, and then go through RH vacuum degassing. See Table 1 for constituents control.

(2) Continuous casting: Cast molten steel into 150 mm thick continuous casting slab. Control the casting temperature at 5-25° C. above the liquidus. Dynamic soft reduction is implemented during casting. See Table 2 for continuous casting process parameters.

(3) slab slow cooling treatment: continuous casting slab enters the pit for slow cooling and hydrogen expansion. See Table 2 for pit temperature and slow cooling time. After slow cooling, the slab surface shall be polished and cleaned by machine, so that the upper and lower surfaces shall be cleaned up by removing 1.5 mm thick respectively.

(4) Heating: Put the continuous casting slab obtained in step (3) into the stepping type furnace, with an average heating rate of 10-14 cm/min, and heat it to 1180-1250° C. Heat holding shall be started when the core temperature reaches the surface temperature, and the heat holding time shall not be less than 1 hour. The alloy elements in the steel are fully dissolved to ensure the uniformity of constituents and properties of the final product. The heating time in the temperature range of 600-900° C. shall be controlled to be ≥0.32 min/mm.

(5) Rolling: after the slab is removed out of the furnace and descaled by high-pressure water, the two-stage controlled rolling of rough rolling and finish rolling is carried out. The start temperature of rough rolling is 1080-1150° C., and the reduction rate of the last three passes of rough rolling is ≥12%. The thickness of an intermediate slab≥1.8 h, where h is the thickness of finished product. High temperature rolling is adopted for finish rolling. The start temperature of finish rolling is 900-980° C., and the end temperature of rough rolling is ≥820° C. After rolling, the steel plate is cooled by air without accelerated cooling by ACC unit. See Table 3 for relevant process parameters.

(6) Quenching: The quenching temperature of steel plate is 840±10° C., and the holding time after the furnace temperature reaches the temperature is 30-60 min; The secondary quenching temperature is 625±10° C., and the holding time after the furnace temperature reaches the temperature is 30-60 min; The quenching medium is water.

(7) Tempering: the tempering temperature of steel plate is 560±10° C., and the holding time is 120-180 min.

(8) After tempering, the steel plate shall be subjected to transverse tensile and transverse impact tests.

See table 1-3 for specific constituents and process parameters. See Table 4 for the corresponding properties of each embodiment.

Figure 2:
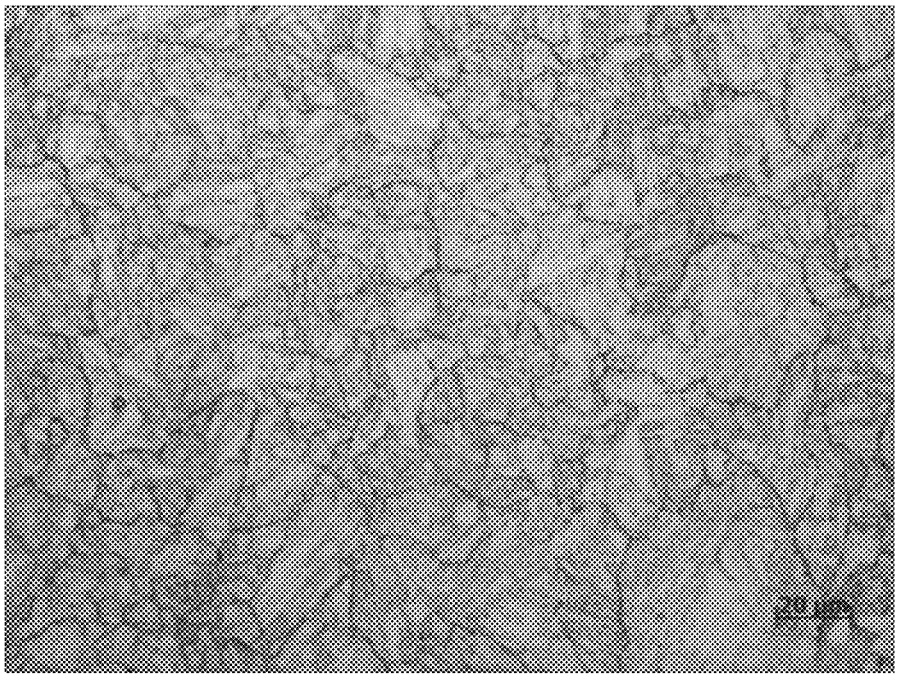
FIG. 2 shows the microstructure of the test steel in embodiment 2 of the invention after secondary quenching and the initial austenite grain morphology corroded by picric acid alcohol solution.

FIGS. 1 and 2 show the microstructure photos of the test steel in embodiment 1 and 2. The microstructure of the finished steel plate is tempered sorbite structure. After secondary quenching, the large grain size of the original austenite is ≥40 um and the small grain size is less than 10 um. It can be seen that through two-stage controlled rolling &cooling and the selection of appropriate quenching process parameters, multi-size original austenite grains can be obtained, the yield ratio of steel plate can be reduced and the elongation of steel plate can be improved. In the tempering process, close to $AC_1$ point, conduct heat preservation treatment for a long time to coarsen the ferrite layer. Further reduce the yield ratio and improve the elongation.

The invention adopts high-temperature controlled rolling and off-line quenching+tempering process, which is controlled from the aspects of chemical constituents design, base metal structure, inclusions, center segregation, quenching and tempering temperature and time, so as to ensure that the elongation and −196° C. low-temperature impact toughness of the steel are good while realizing ultra-high strength, and achieve the purpose of reducing the low yield strength ratio of thin 9Ni steel plate.

TABLE 1 chemical composition of super strong steel plate in embodiment (wt%)

| Embodiment | C | Si | Mn | P | S | Cr | Ni | Nb | Al | Ca | O | N | H |
|---|---|---|---|---|---|---|---|---|---|---|---|---|---|
| 1 | 0.03 | 0.13 | 0.70 | 0.0033 | 0.0003 | 0.15 | 9.35 | 0.0145 | 0.025 | 0.0009 | 0.0009 | 0.00189 | 0.0001 |
| 2 | 0.02 | 0.18 | 0.72 | 0.0039 | 0.0007 | 0.22 | 9.45 | 0.0160 | 0.025 | 0.0012 | 0.0007 | 0.00171 | 0.0001 |
| 3 | 0.03 | 0.28 | 0.69 | 0.0048 | 0.0007 | 0.10 | 9.34 | 0.0134 | 0.021 | 0.0016 | 0.0010 | 0.00185 | 0.0001 |
| 4 | 0.04 | 0.16 | 0.78 | 0.0047 | 0.0006 | 0.18 | 9.10 | 0.0134 | 0.021 | 0.0016 | 0.0006 | 0.00191 | 0.0001 |

TABLE 2 continuous casting process control

| Embodiment | slab thickness, mm | Overheat, ° C. | Dynamic soft reduction, fs | Start temperature of slow cooling, ° C. | Hydrogen expansion time, hour |
|---|---|---|---|---|---|
| 1 | 150 | 25 | 0.35-0.95 | 690 | 48 |
| 2 | 150 | 18 | 0.35-0.95 | 650 | 48 |
| 3 | 150 | 15 | 0.35-0.95 | 680 | 48 |
| 4 | 150 | 15 | 0.35-0.95 | 700 | 48 |

TABLE 3 rolling process control

| Embodiment | Product thickness specification, mm | slab tapping temperature, ° C. | Reduction rate of three passes after rough rolling | Thickness to be heated, mm | Start temperature of finish rolling, ° C. | Ending temperature of finish rolling, ° C. |
|---|---|---|---|---|---|---|
| 1 | 12 | 1230 | 26% + 26% + 26% | 26 | 823 | 829 |
| 2 | 16 | 1220 | 23% + 25% + 26% | 32 | 920 | 826 |
| 3 | 30 | 1230 | 16% + 17% + 16% | 60 | 984 | 40 |
| 4 | 50 | 1220 | 12% + 15% + 16% | 90 | 860 | 625 |

TABLE 4

Transverse tensile and transverse impact properties of embodiments of the invention

| Embodiment | Thickness, mm | Tensile: Yield strength, MPa | Tensile: Tensile strength, MPa | Tensile: Yield ratio | Tensile: Elongation, % | Impact energy, Akv, J | | | |
|---|---|---|---|---|---|---|---|---|---|
| 1 | 12 | 672 | 755 | 0.89 | 22 | −196° C. | 240 | 235 | 233 |
| 2 | 16 | 671 | 746 | 0.90 | 23 | −196° C. | 211 | 229 | 242 |
| 3 | 32 | 684 | 778 | 0.88 | 21 | −196° C. | 213 | 208 | 225 |
| 4 | 50 | 669 | 752 | 0.89 | 23 | −196° C. | 205 | 237 | 215 |

Although the preferred embodiments of the invention have been described in detail above, it should be clearly understood that the invention may have various modifications and changes or those skilled in the art. Any modification, equivalent replacement, improvement, etc. made within the spirit and principles of the invention shall be included in the protection scope of the invention.

The invention claimed is:

1. A production method of 9Ni steel plate for ship LNG storage tank with high strength and low yield ratio, which is characterized in that it comprises the following steps:

(1) Molten steel smelting: the smelting raw materials are successively processed by converter smelting, RH refining, LF refining and RH refining;

(2) Casting into slab: the casting overheat is controlled at 5-25° C., and the soft reduction meets 0.35≤fs≤0.95, where fs is the fraction of solid in the slab; the center segregation of the slab is not higher than grade C1.0;

(3) Slow cooling and surface cleaning of the slab: the slab is put into a pit or covered for slow cooling treatment, wherein an initial temperature of slow cooling is not lower than 600° C., the slow cooling lasts for more than 48 hours; after slow cooling, the slab surface is cleaned and polished;

(4) Heating a stepping type furnace is adopted, wherein an average heating rate is controlled at 10-14 cm/min, heating to 1180-1250° C., and the heating time in the range of 600-900° C. is not less than 0.32 min/mm, heat holding is started when a core temperature is consistent with a surface temperature, and the holding time is not less than 1 hour; the alloy elements are fully dissolved in the steel, to ensure uniform constituents and properties in the final product;

(5) Rolling after the slab is removed out of the furnace, it is subject to high-pressure water descaling treatment, and two-stage controlled rolling including rough rolling and finish rolling, to refine the grain: a start rolling temperature of rough rolling is 1080-1150° C., the reduction rate of the last three passes of rough rolling is ≥15%, and the thickness of an intermediate slab is ≥1.8 h, where H is the thickness of a finished product; high temperature rolling is adopted for the finish rolling, and a start rolling temperature is between 900-980° C.; after rolling, air cooling is adopted;

(6) Quenching after rolling, the steel plate is quenched off-line, a primary quenching temperature is 840±10° C., the holding time is 30-60 min after the furnace temperature reaches the desired temperature; a secondary quenching temperature is 625±10° C., and the holding time is 30-60 min after the furnace temperature reaches the desired temperature; the quenching medium is water;

(7) Tempering the quenched steel plate is tempered, wherein the tempering temperature is 560+10° C. and the holding time is 120-180 min.

2. The production method of 9Ni steel plate for ship LNG storage tank with high strength and low yield ratio according to claim 1, characterized in that step (1) molten steel smelting is based on the chemical constituents of C: 0.02-0.05%, Si: 0.10-0.30%, Mn: 0.50-0.80%, Ni: 8.90-9.50%, P: ≤0.0070%, s: ≤0.0020%, Cr: 0.10-0.25%, Alt: 0.010-0.035%, Nb: 0.010-0.020%, Ca: 0.0005-0.0030%, O: ≤0.0012%, N: ≤0.004%, H: ≤ 0.00015%, and the balance is Fe and unavoidable impurity elements.

3. The production method of 9Ni steel plate for ship LNG storage tank with high strength and low yield ratio according to claim 2, characterized in that in step (3), upper and lower surfaces of the casting slabs are polished respectively, so that 1.5 mm thick is removed from the upper and lower surfaces respectively.

4. The production method of 9Ni steel plate for ship LNG storage tank with high strength and low yield ratio according to claim 3, characterized in that in step (6), after secondary quenching, large and small sizes of initial austenite grains coexist, wherein the large grain size is ≥40 μm and the small size is less than 10 um; finally, the microstructure is tempered sorbite, and the ferrite lamella reaches a maximum of 2 um.

* * * * *